United States Patent [19]

Alsup, Jr. et al.

[11] 4,360,281

[45] Nov. 23, 1982

[54] REVERSIBLE CAM LOCK ASSEMBLY

[75] Inventors: J. Douglas Alsup, Jr.; Arden F. Jenkins, both of Bay Minette, both of Ala.

[73] Assignee: Syntex (U.S.A.) Inc., Palo Alto, Calif.

[21] Appl. No.: 172,034

[22] Filed: Jul. 24, 1980

[51] Int. Cl.[3] ..... F16B 2/18

[52] U.S. Cl. ..... 403/4; 403/351; 248/411

[58] Field of Search ..... 403/351, 352, DIG. 8, 403/104, 3, 4; 248/188.5, 411, 412

[56] References Cited

U.S. PATENT DOCUMENTS

| | | | |
|---|---|---|---|
| 3,338,626 | 8/1967 | Hamilton | 297/417 X |
| 3,515,418 | 6/1970 | Nielsen, Jr. | 248/188.5 X |
| 4,076,437 | 2/1978 | Mazzolla | 248/411 X |
| 4,085,967 | 4/1978 | Spencer | 297/115 |

FOREIGN PATENT DOCUMENTS

| | | | |
|---|---|---|---|
| 2319059 | 10/1974 | Fed. Rep. of Germany | 403/104 |

*Primary Examiner*—Andrew V. Kundrat
*Attorney, Agent, or Firm*—David A. Lowin; John Dhuey; Joseph I. Hirsch

[57] ABSTRACT

A reversible cam lock assembly is described. The cam lock assembly is adapted for attachment to a movable member and includes an eccentric cam for engaging a surface of a stationary member to resist movement inducing forces applied to the movable member. Depending on the orientation of the cam lock assembly, clockwise or counterclockwise rotational movement of the movable member relative to the stationary member is resisted.

14 Claims, 11 Drawing Figures

REVERSIBLE CAM LOCK ASSEMBLY

BACKGROUND OF THE INVENTION

1. Field of the Invention

The present invention relates to a cam lock assembly. More particularly, it relates to a reversible cam lock assembly useful for preventing either clockwise or counterclockwise rotation, depending on its orientation, of a movable member relative to a stationary member.

2. State of the Art

Typical operatory stools are provided with a body support arm, located above the seat of the stool, for supporting the body of a user in a multitude of positions. Depending on the actual operation being performed by the user, the body support arm may be required to support the back, the abdomen or chest, or the arms of the user. It is desirable that the body support arm be adjustable in a variety of positions to accommodate the different operating positions adopted by the user. Various adjustable body support stools are described in the prior art. For example, U.S. Pat. No. 3,338,626 describes a stool on which the body support arm can be shifted horizontally about the stool seat and also can be tilted with respect to the plane of the seat. U.S. Pat. No. 4,085,967 describes a body support stool supplied with a clutch assembly to permit lateral movement of the body support arm with respect to the stool seat.

It is generally known that an eccentric cam can be utilized to lock two telescoping members and prevent their relative rotation in a predetermined direction. A stool for use in a dental operatory is available which employs a cam lock to prevent movement of a body support arm about a vertical support member. On a right-handed stool, one cam lock which prevents clockwise rotation of the support arm is provided. On a left-handed stool, another different cam lock is provided to prevent counterclockwise rotation of the support arm about a vertical support member. The necessity of two different cam locks requires that two separate parts be available during manufacturing so that either right-handed or left-handed stools can be produced.

The present invention obviates the necessity of having two separate cam locks by providing, in a single, unitary assembly, a cam lock which can be used for either right-handed or left-handed stools to resist clockwise or counterclockwise movement, respectively.

SUMMARY OF THE INVENTION

The present invention is directed to a cam lock assembly comprising shaft means having a first end and a second end, the first and second ends being adapted for attachment to a first member; a cam eccentrically mounted on the shaft means intermediate the first and second ends, the cam being adapted for engaging a surface of a second member; and means securing the cam to the shaft means, whereby the cam cooperates with the surface of the second member to resist clockwise rotational movement of the first member relative to the second member when the first end of the shaft means is attached to the first member and counterclockwise rotational movement of the first member relative to the second member when the second end of the shaft means is attached to the first member.

DETAILED DESCRIPTION OF THE DRAWINGS

FIG. 1 has a perspective view of a stool in which the present invention can be utilized;

DETAILED DESCRIPTION OF THE INVENTION

Figure 1:
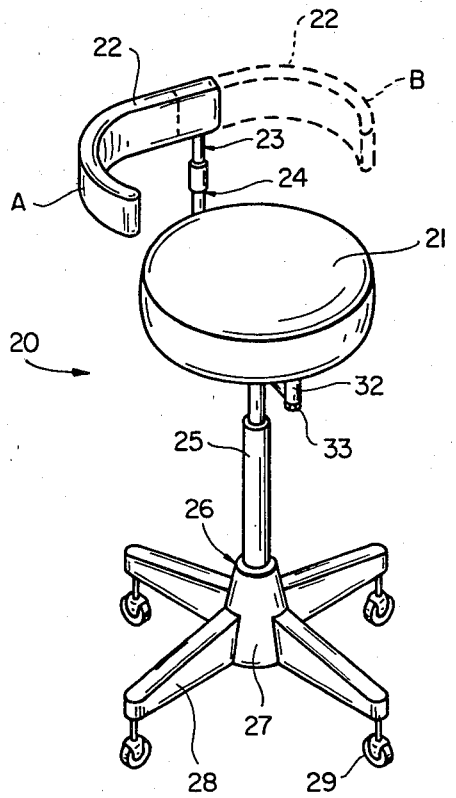

For purposes of the specification, "right-hand" or "right-handed" position or side is defined by position A of the body support arm illustrated in FIG. 1 and "left hand" or "left-handed" position or side is defined by position B of the body support arm illustrated in dotted outline in FIG. 1. Use of the stool when the body support arm generally is in a position A is considered right hand use, and, when the body support arm is generally in position B, it is considered left hand use.

With reference to the drawings, the stool 20 comprises a seat 21 and an arcuate body support arm 22 positioned above the level of seat 21. Support means such as vertical support 23 and seat connector 24 are provided between body support arm 22 and seat 21. Means depending from seat 21 for engaging a support surface such as a floor or the like may be any conventional means employed for such a purpose. Typically, an elongated seat support member 25 is secured to the bottom surface of seat 21 and connected to a base generally designated 26 which includes a hub 27 from which depend legs 28. In order to facilitate movement of stool 20 within the operatory environment, casters 29 are provided on each of dependent legs 28 for easy movement. As will be discussed more fully hereinafter, body support arm 22 is rotatable between a position A and a position B about vertical support 23 as illustrated in FIG. 1.

Figure 2:
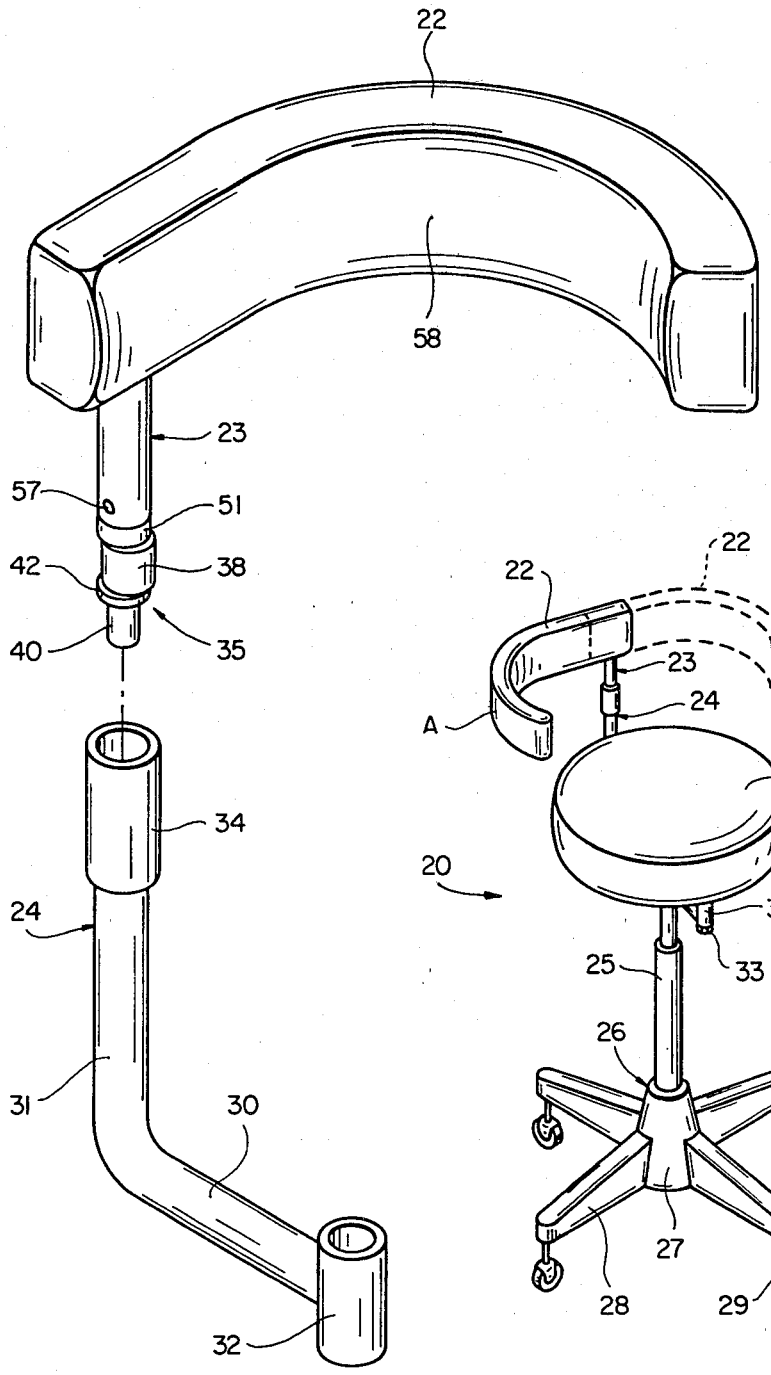
FIG. 2 is a view of the lower connecting arm and cam lock assembly of the stool of FIG. 1.

Body support arm 22 is supported in a spaced relationship from seat 21 by means of a tubular, seat connector 24 which is goose-necked in shape. As shown in FIG. 2, seat connector 24 has a substantially horizontal arm 30 and a substantially vertical arm 31. Horizontal arm 30 terminates in a hollow sleeve 32 which is attached to seat 21 by means of a stud fastened to the bottom of seat 21 and a collar 33, which holds connector 24 in place on the stud. The stud serves as a shaft about which sleeve 32 and seat connector 24 can rotate. Sleeve 32 is attached to seat 21 at an off-center position so that the travel of seat connector 24 is limited about the periphery of seat 21. Rotation of seat connector 24 to an extreme position will cause vertical arm 31 of seat connector 24 to contact the periphery of seat 21 where further movement is prevented.

Vertical arm 31 is tubular and has an end 34 which is adapted to receive therein the cam lock assembly 35 of the present invention. Cam lock assembly 35 is attached at an end thereof to vertical support 23 by means of pin 57.

Figure 9:
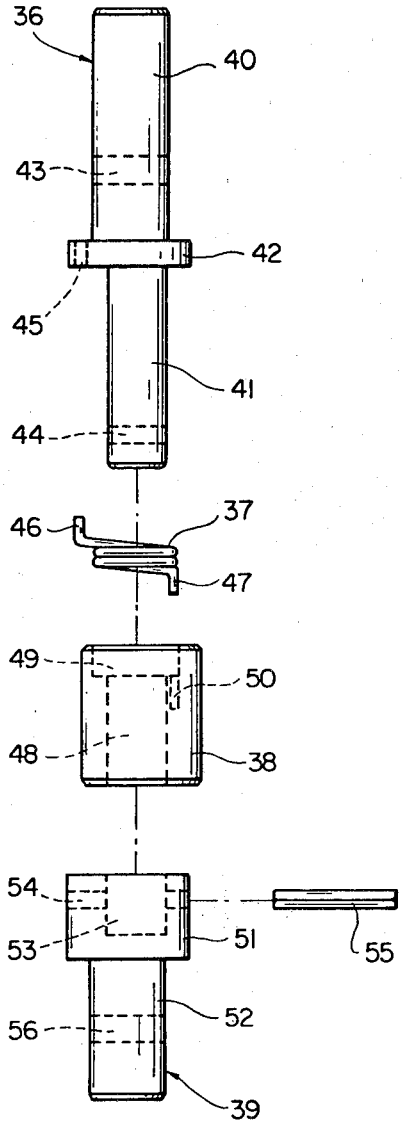
FIG. 9 is an exploded view of the cam lock assembly of FIG. 2.

As is seen most clearly from FIG. 9, cam lock assembly 35 of the present invention comprises an eccentric shaft 36 having an outer shaft 40 and an inner shaft 41 which are inter-connected by flange 42. Inner shaft 41 passes through an eccentric cam 38 having a bore 48 therethrough which is offset from the central axis of the cam. Eccentric cam 38 is spring loaded by means of spring 37 which is accommodated in a centrally located counterbore 49. Spring 37 is formed with an end 47 which is adapted to engage hole 50 in eccentric cam 38 and an end 46 which is adapted to engage hole 45 in flange 42 of eccentric shaft 36. Spring 37 exerts a force on eccentric cam 38 which biases eccentric cam 38 toward a position in contact with the inner wall of vertical arm 31. In that manner, free play between the outer surface of eccentric cam 38 and the inner wall of vertical arm 31 is substantially eliminated.

Inner shaft 41 passes entirely through bore 48 in eccentric cam 38 and is seated within an offset bore 53 in head 51 of stem 39. A transversely extending hole 54 is provided across head 51 to align with hole 44 in inner shaft 41 when inner shaft 41 is seated within head 51. A spring pin 55 is inserted through holes 54 and 44 to rigidly connect inner shaft 41 with stem 39. Stem 39 is provided with a stem shaft 52 having a transversely located hole 56 therein. Outer shaft 40 of eccentric shaft 36 also is provided with a transversely extending hole 43. Holes 43 and 56 are employed to secure cam lock assembly 35 to vertical support 23.

Figure 10:
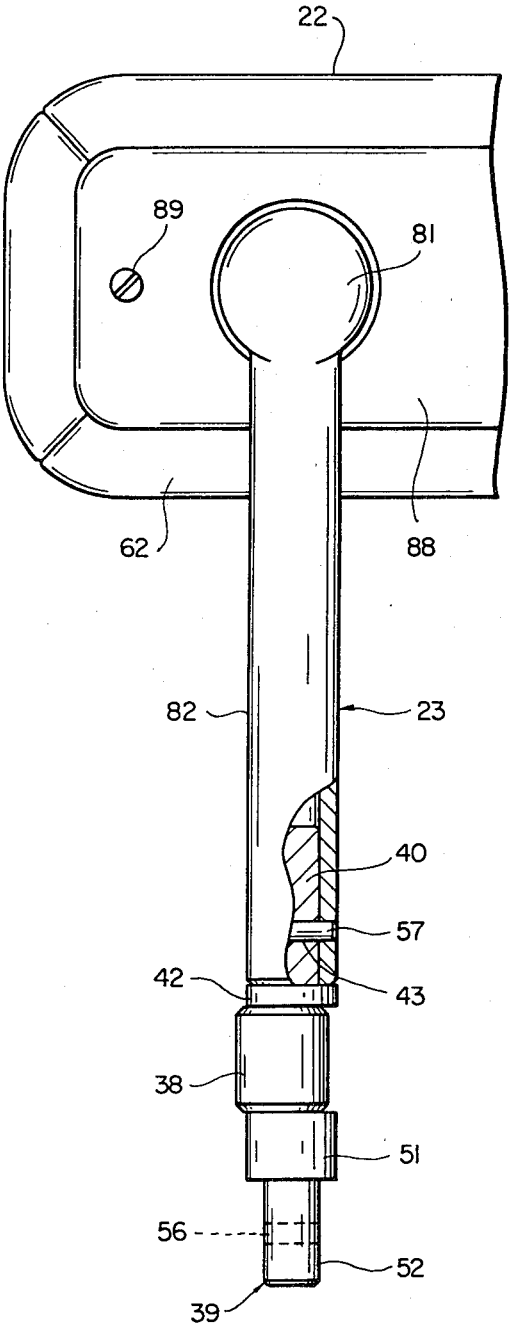
FIG. 10 is a rear elevational view, partly in section of the cam lock assembly mounted in the vertical support member of FIG. 7 for preventing clockwise rotation of the body support arm.

Cam lock assembly 35 comprises a unitary assembly which can be reversibly utilized in cooperation with vertical arm 31 to resist either clockwise or counterclockwise rotation of body support arm 22 in a horizontal plane about seat connector 24, depending on the orientation of cam lock assembly 35. Clockwise rotation of body support arm 22 about connector 24 is prevented when cam lock assembly 35 is oriented as shown in FIG. 10, wherein outer shaft 40 is inserted into vertical support 23 and retained therein by pin 57 extending through hole 43. In that configuration, eccentric cam 38 is biased in a counterclockwise direction by spring 37 to maintain contact between the outer wall of eccentric cam 38 and the inner wall of vertical arm 31. The forces on body support arm 22 generated by the pressure of a user's body thereon tend to move body support arm 22 about seat connector 24 in a clockwise manner, which movement is resisted by the engagement of the outer surface of eccentric cam 38 with the inner surface of connector 34.

Figure 11:
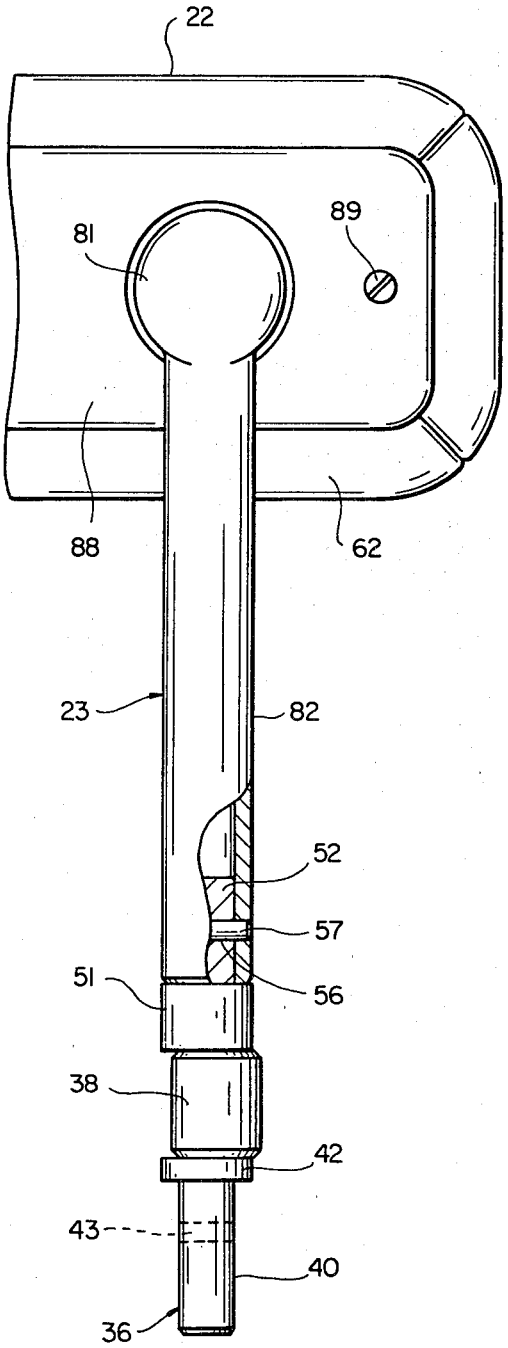
FIG. 11 is a rear elevational view, partly in section, of the rotational lock assembly mounted in the vertical support member of FIG. 7 for preventing counterclockwise rotation of the body support arm.

FIG. 11 illustrates the reverse orientation wherein counterclockwise forces generated by pressure of a user on body support arm 22 are resisted. In that configuration, stem 52 is inserted within vertical support 23 and retained therein by pin 57 through hole 56. Eccentric cam 38 is biased in a clockwise direction by spring 37 to maintain contact between the outer wall of eccentric cam 38 and the inner wall of vertical arm 31. Forces generated by the pressure of a portion of the user's body on support arm 22 which tend to move body of support arm 22 about seat connector 24 in a counterclockwise direction are resisted by the engagement of the outer surface of eccentric cam 38 and the inner wall of vertical arm 31.

Accordingly, in a single assembly the present invention provides a reversible cam lock mechanism which effectively resists clockwise or counterclockwise rotational forces depending on the position of body support arm 22 relative to seat connector 24 and the orientation of cam lock assembly 35 in vertical support 23.

The top and bottom circumferential edges of eccentric cam 38 are beveled to assist in the location of eccentric cam 38 into end 34. To insert body support arm 22 and vertical support 23 along with cam lock assembly 35 into end 34 of vertical arm 31 of seat connector 24, one inserts shaft 40 and flange 42, or shaft 52 and head 51, depending on the orientation of cam lock assembly 35, into end 34. Then eccentric cam 38 is moved against the bias of spring 37 by rotating body support arm 22 while applying a downward force thereto until eccentric cam 38 becomes aligned with end 34, at which point vertical support 23 and body support arm 22 can be pressed downwardly to position cam lock assembly 35 into vertical arm 31. Locking of body support arm 22 and vertical support 23 within vertical arm 31 is accomplished by rotating body support arm 22 in a direction such that cam 38 engages the inner surface of vertical arm 31. In order to release cam lock assembly 35, one pulls upwardly on support arm 22 and rotates body support arm 22 and vertical support 23 in a direction opposite to the locking direction.

Figure 3:
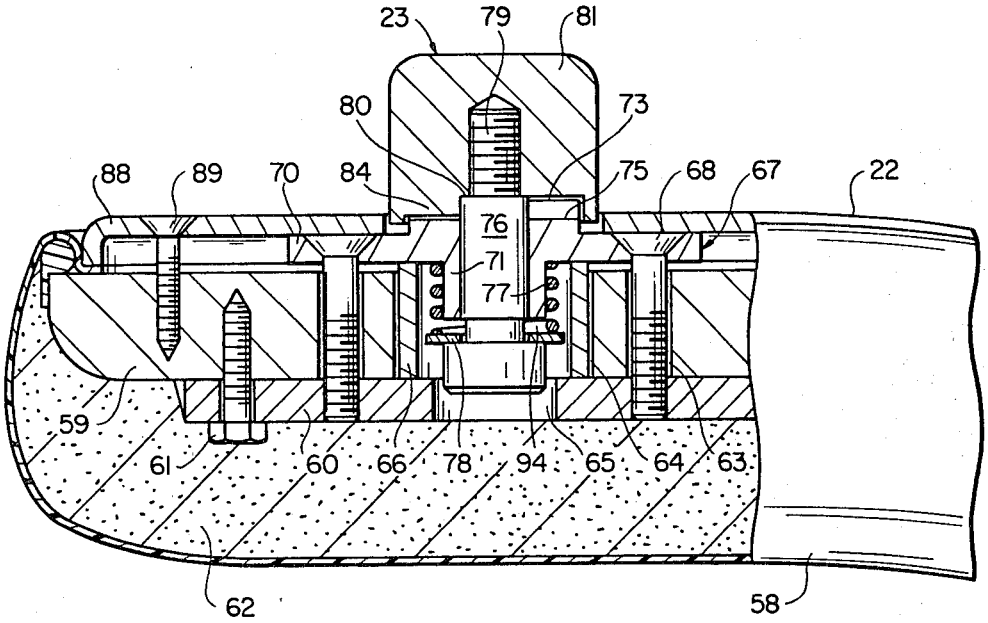
FIG. 3 is a top, detailed view, partly in section, of the reversible positioning means of the stool of FIG. 1.

As shown in FIG. 3, body support arm 22 is formed with a concave inner surface 58 by forming a cushion 62 over a curved core member 59. A backing plate 88 is provided along substantially the length of body support arm 22 and held to core member 59 by screws 89 to cover a support plate 67 described hereinafter and the fasteners holding cushion member 62 in place. Core member 59 may be made of wood, plastic, metal or the like. Attached to core member 59 by means of screws 61 is an inner plate 60. Core member 59 and inner plate 60 are formed with holes 64 and 65, respectively, to accommodate portions of the reversible positioning means for body support arm 22.

The reversible positioning means includes cooperative means on body support arm 22 and vertical support 23 for permitting rotation of the body support arm 22 through a 180° arc about vertical support 23. The reversible positioning means includes a support plate 67 fastened to the rear side of the core member 59 by screws 68, which extend through holes 63 and are fastened into inner plate 60. A cylindrical spacer element 66 is located within hole 64 and extends between inner plate 60 and support plate 67. Spacer 66 is coaxial with holes 64 and 65 and supports support plate 67 in a spaced relationship, such that the inner surface of support plate 67 does not contact the rear surface of core member 59.

Figure 4:
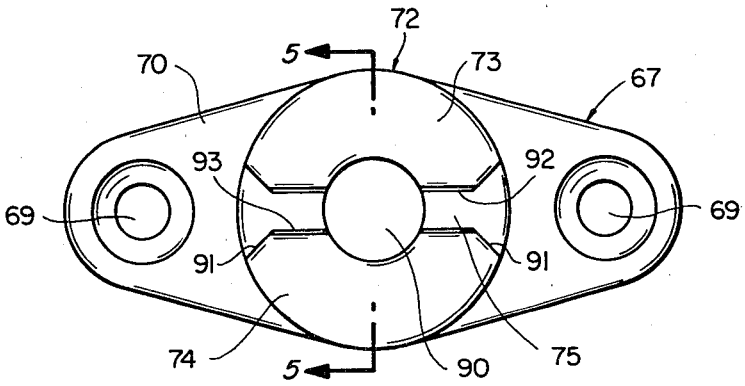
FIG. 4 is a rear elevational view of the support plate of the reversible positioning means of FIG. 3.
Figure 5:
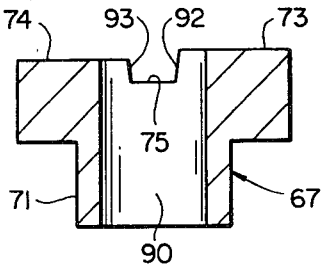
FIG. 5 is a sectional view of the support plate of FIG. 4 along the line 5—5.

With particular reference to FIGS. 4 and 5, support plate 67 is constructed with a central neck 71 and a peripheral flange 70. Located within flange 70 are tapered holes 69 for receiving screws 68 which attach support plate 67 to inner plate 60. Neck 71 is adapted to extend inwardly into spacer 66 which is located in hole 64 of core member 59. A central bore 90 extends through neck 71 and the remainder of support plate 67 to cylindrical face 72. Face 72 is bilevel and is formed with a high surface 73 and a lower surface 74, the function of which will be explained hereinafter. Surfaces 73 and 74 are each substantially semicircular about their periphery, extending from the edges of groove 75 which is formed in face 72 to the outer circumference of face 72. Groove 75 is formed with beveled outward edges 91 and a tapered wall 92, adjacent high surface 73, and a tapered wall 93, adjacent low surface 74.

Figure 8:
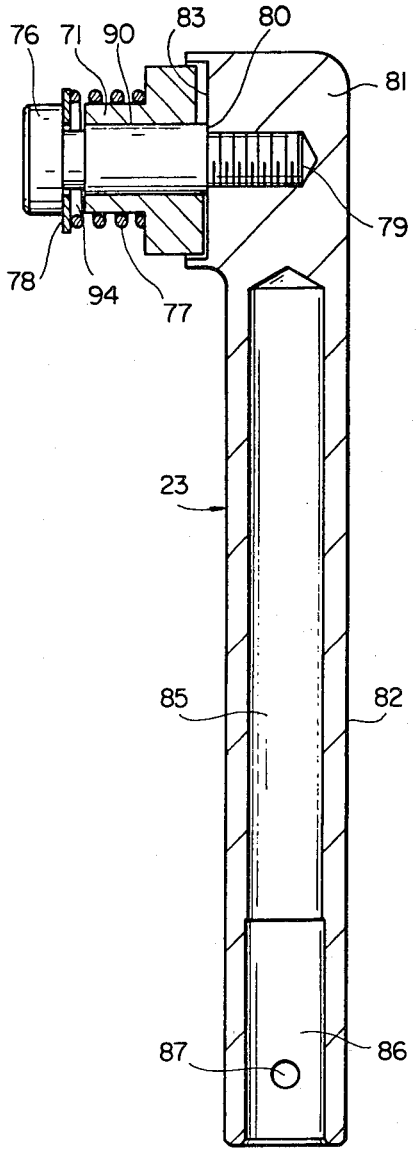
FIG. 8 is a cross-sectional view of the reversible positioning means mounted on the vertical support member of FIG. 7, the body support arm not shown for clarity.

As can best be seen in FIGS. 3 and 8, positioned about neck 71 of support plate 67 is a spring 77 which is held between flange 70 and a spacer washer 78 by the head of a bolt 76. Bolt 76 extends through bore 90 of the support plate 67 and fastens support plate 67 to vertical support 23. Spring 77 urges spacer washer 78 and bolt 76 away from the end of neck 71, thereby drawing support plate 67 toward vertical support 23.

Figure 6:
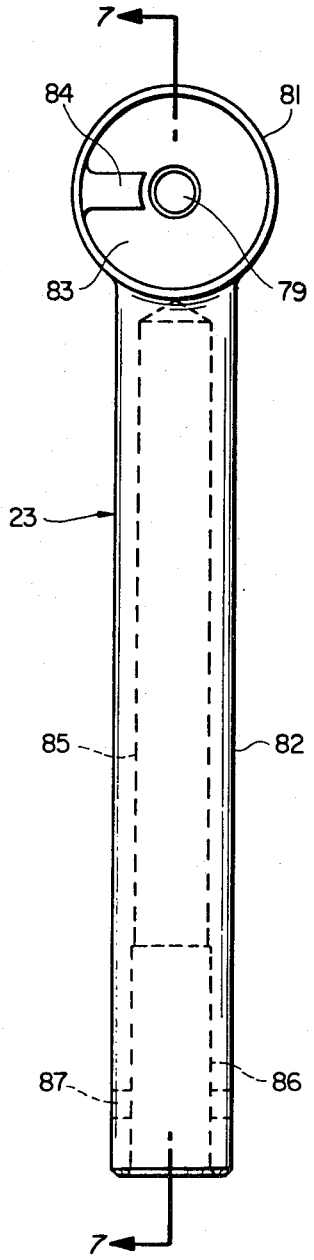
FIG. 6 is a front elevational view of a vertical support member of the connecting means between the body support arm and the seat of the stool of FIG. 1.
Figure 7:
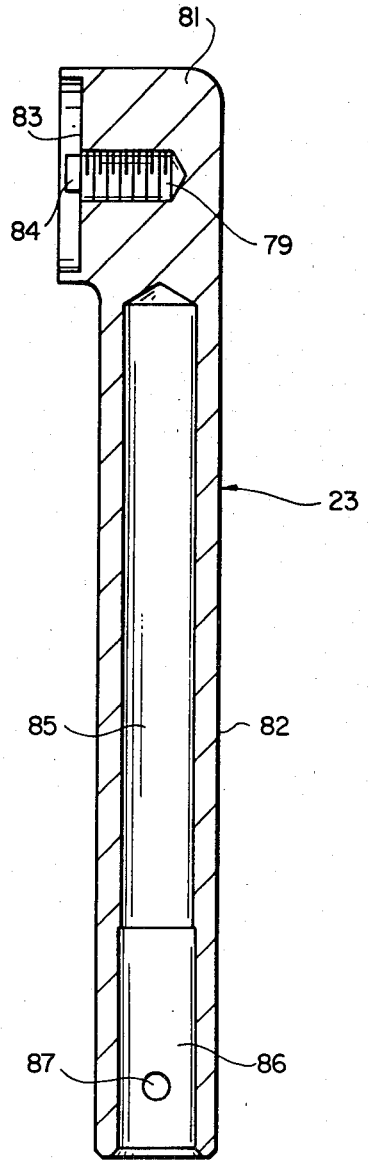
FIG. 7 is a sectional view along line 7—7 of the vertical support member of FIG. 6.

As shown in FIG. 6, vertical support 23 is formed with a head 81 and a leg 82. Leg 82 is formed with a bore 85 and a counterbore 86 which is adapted to receive outer shaft 40 or stem shaft 52, depending on the orientation of cam lock assembly 35. A hole 87 extends transversely through leg 82 and provides an insertion location for lock pin 57 which attaches cam lock assembly 35 to vertical support 23. Head 81 of support member 23 is provided with a recessed surface 83 lying in a vertical plane on a side thereof which faces inwardly toward body support arm 22. A threaded hole 79 is centrally located within head 81 and is perpendicular to recessed surface 83. Extending from an outer edge of recessed surface 83 radially toward the center of head 81 is an ear 84 which is adapted to be received into groove 75 of support plate 67 when body support arm 22 is in a secured position. Additionally, ear 84 provides a contact surface on the upper and lower edges thereof for engaging a portion of tapered wall 92 of groove 75 in support plate 67.

As can be seen most clearly from FIGS. 3 and 8, bolt 76 passes through neck 71 of support plate 67 and is threaded into hole 79 in head 81 of vertical support 23. A shoulder 80 is provided on bolt 76 to engage a portion of recessed surface 83 and form a gap 94 between spacer washer 78 and the end of neck 71 of support plate 67. Gap 94 permits support plate 67 and body support arm 22 attached thereto to be laterally moved in a direction away from head 81 of vertical support 23. That movement is limited by the size of gap 94 which is dimensioned to permit sufficient movement of support plate 67 such that groove 75 disengages from ear 84. In that manner, support plate 67 and body support arm 22 can be rotated in a 180° arc extending upwardly in a vertical plane about head 81 of vertical support 23. The size of gap 94 is not made so large, however, that wall 92 adjacent high surface 73 can be withdrawn sufficiently to avoid contacting ear 84 when body support arm 22 has completed its 180° rotation. At that point further rotation of body support arm 22 is impeded and ear 84 will engage slot 75 under the urging of spring 77. As shown in FIG. 3, when body support arm 22 is in its left-handed position, wall 92 contacts the bottom surface of ear 84. When body support arm 22 is rotated to the right-handed position, wall 92 contacts the top surface of ear 84. In that manner only 180° of rotation of the body support arm 22 about the vertical support 23 is permitted.

The reversible positioning means is located adjacent an end of the arcuate, body support arm 22 such that body support arm 22 depends from either one side or the other side of vertical support member 23. Ear 84 is positioned horizontally within head 81 of vertical support 23 such that when it engages slot 75 of support plate 67, body support arm 22 attached thereto depends in a substantially horizontal plane from either one or the other side of vertical support 23.

Only two operations are necessary to interchange the body support arm 22 from left-handed to right-handed operation or vice versa. Firstly, body support arm 22 is grasped near head 81 of vertical support 23 and pulled toward the center of seat 21. This releases the lock between ear 84 and groove 75, allowing body support arm 22 to be rotated upwardly through 180° to the opposite side of vertical support 23, where when released, body support arm 22 will lock itself in that position. Next, body support arm 22 and vertical support 23 with cam lock mechanism 35 are removed from connector 34 by turning the enter assembly in a direction opposite to the locking direction and pulling upwardly. Once the entire assembly is removed, pin 57 holding cam lock assembly 35 in place is removed, and cam lock assembly 35 is turned upside down. Pin 57 then is replaced within hole 87 of vertical support 23 and the entire assembly is replaced in connector 34 in a manner hereinbefore described. Accordingly, by a very simple set of manual operations, a right-handed stool can be converted to a left-handed stool and vice versa.

While this invention has been described with reference to the specific embodiments thereof, it should be understood by those skilled in this art that various changes can be made and equivalents may be substituted without departing from the true spirit and scope of the invention. All such modifications are intended to be within the scope of the claims appended hereto.

What is claimed is:

1. A cam lock assembly comprising:

shaft means having a first end and a second end, said first end and said second end each being adapted for attachment to a first member;

a cam eccentrically mounted on said shaft means intermediate said first and second ends, said cam being adapted for engaging a surface of a second member; and means securing said cam to said shaft means, whereby said cam cooperates with the surface of the second member to resist clockwise rotational movement of the first member relative to the second member when said first end of said shaft means is attached to the first member and counterclockwise rotational movement of the first member relative to the second member when said second end of said shaft means is attached to said first member.

2. The cam lock assembly of claim 1 wherein said securing means includes means biasing said cam in a predetermined direction about said shaft means.

3. The cam lock assembly of claim 2 wherein said biasing means is a spring.

4. The cam lock assembly of claim 1 wherein said shaft means comprises a shaft portion intermediate said first end and said second end of said shaft means, the longitudinal axis of said shaft portion being offset from the longitudinal axis of said first and second ends of said shaft means.

5. The cam lock assembly of claim 4 wherein said cam has a longitudinal bore extending therethrough and offset from the longitudinal axis of said cam, said shaft portion being slidably received within said longitudinal bore.

6. The cam lock assembly of claim 5 wherein said securing means comprises a spring circumscribing said shaft portion, said spring having a first end secured to said shaft means and a second end secured to said cam.

7. A cam lock assembly of claim 6 wherein said spring biases said cam toward engagement with the second member.

8. The cam lock assembly of any of claims 1–7 wherein said first member is movable and said second member is stationary.

9. A cam lock assembly comprising:

an eccentric shaft having an outer shaft and an inner shaft, the longitudinal axis of said inner shaft being offset from the longitudinal axis of said outer shaft;

a cam having a first bore therethrough, the longitudinal axis of said first bore being offset from the longitudinal axis of said cam, said inner shaft being slidably received within said first bore and extending therethrough;

a stem having a head and a stem shaft extending from said head, said head having an axial, second bore therein, the longitudinal axis of said second bore being offset from the longitudinal axis of said stem shaft, said inner shaft being secured within said second bore; and means securing said cam to said eccentric shaft.

10. The cam lock assembly of claim 9 wherein said securing means includes means biasing said cam in a predetermined direction about said eccentric shaft.

11. The cam lock assembly of claim 10 wherein said biasing means is a spring.

12. The cam lock assembly of claim 10 wherein said securing means comprises a spring circumscribing said eccentric shaft, said spring having a first end secured to said eccentric shaft and a second end secured to said cam.

13. The cam lock assembly of claim 12 wherein said cam has a centrally located counterbore therein to accommodate said spring.

14. The cam lock assembly of claim 12 wherein said eccentric shaft further comprises a flange between said outer shaft and said inner shaft, said flange having means thereon to receive an end of said spring.

* * * * *